US010602851B2

(12) United States Patent
Xu

(10) Patent No.: US 10,602,851 B2
(45) Date of Patent: Mar. 31, 2020

(54) ELECTRIC BED FRAME

(71) Applicant: Jiaxing Shufude Electric Bed Co., Ltd., Jiaxing, Zhejiang Province (CN)

(72) Inventor: Jianchun Xu, Jiaxing (CN)

(73) Assignee: Ergomotion, Inc., Goleta, CA (US)

( * ) Notice: Subject to any disclaimer, the term of this patent is extended or adjusted under 35 U.S.C. 154(b) by 705 days.

(21) Appl. No.: 15/248,622

(22) Filed: Aug. 26, 2016

(65) Prior Publication Data

US 2017/0071356 A1 Mar. 16, 2017

(30) Foreign Application Priority Data

Aug. 27, 2015 (CN) ..... 2015 2 0652877 U

(51) Int. Cl.
*A47C 19/02* (2006.01)
*A47C 20/04* (2006.01)
*A47C 19/00* (2006.01)

(52) U.S. Cl.
CPC ..... *A47C 19/021* (2013.01); *A47C 19/005* (2013.01); *A47C 20/041* (2013.01)

(58) Field of Classification Search
CPC ..... A61G 7/012; A61G 7/015; A61G 7/018; A47C 20/04; A47C 20/041; A47C 19/005; A47C 19/02; A47C 19/021; A47C 19/024; A47C 19/025; A47C 19/04; A47C 19/045; A47C 19/12
USPC ..... 5/282.1, 285, 286, 288, 304, 200.1, 201, 5/613, 616–618
See application file for complete search history.

(56) References Cited

U.S. PATENT DOCUMENTS 2,567,619 A * 9/1951 Rosenfeld ..... A47C 19/024 280/659
2,721,338 A * 10/1955 Resnick ..... A47C 19/005 5/201
3,123,837 A * 3/1964 Paine et al. ..... A47C 19/04 5/181
3,317,931 A * 5/1967 Benoit et al. ..... A61G 7/015 5/616
3,593,350 A * 7/1971 Knight ..... A47C 20/041 5/616
3,898,702 A * 8/1975 Goodman ..... A61G 7/015 5/618
5,257,428 A * 11/1993 Carroll ..... A47C 19/122 5/201

(Continued)

*Primary Examiner* — Robert G Santos
(74) *Attorney, Agent, or Firm* — Felix L. Fischer

(57) ABSTRACT

An electric bed frame, comprising a main frame which has a pair of longitudinal rail members and a pair of transverse rail members, each longitudinal rail member has a guide slot; a secondary frame comprising at least four rotatable rollers adapted to be inserted in the guide slots of the main frame and run a movement with respect to the main frame in the guide slots; and wherein the longitudinal rail members of said main frame are connected with the adjacent transverse rail members via main frame riveted plates. The bed frame of the invention is easy for assembly. In this way, when the parts plant is far away from the assembly plant, each part of the bed frame can be transported in the form of parts and get assembled after reaches the assembly plant, so as to save transportation cost, meanwhile, the strength of the bed frame assembled in this way is equivalent to that of a welded bed frame.

7 Claims, 3 Drawing Sheets

(56) References Cited

U.S. PATENT DOCUMENTS

| | | | | | |
|---|---|---|---|---|---|
| 5,438,723 | A * | 8/1995 | Carroll | A47C 19/122 | 16/267 |
| 6,006,379 | A * | 12/1999 | Hensley | A47C 20/041 | 5/616 |
| 6,209,157 | B1 * | 4/2001 | Hensley | A47C 20/041 | 5/613 |
| 6,276,011 | B1 * | 8/2001 | Antinori | A47C 20/041 | 5/613 |
| 6,708,358 | B2 * | 3/2004 | Hensley | A47C 20/041 | 5/613 |
| 6,990,698 | B2 * | 1/2006 | Wall, Sr. | A47C 19/005 | 5/618 |
| 2001/0000828 | A1 * | 5/2001 | Hensley | A47C 20/041 | 5/618 |
| 2005/0251917 | A1 * | 11/2005 | Wall, Sr. | A47C 19/005 | 5/618 |
| 2017/0071356 | A1 * | 3/2017 | Xu | A47C 19/021 | |

* cited by examiner

ELECTRIC BED FRAME

BACKGROUND

Field of the Invention

The present invention relates to a bed frame, in particular an electric bed frame, wherein such electric bed frame is mainly comprised of members, and may further comprises a main frame and a secondary frame which is slidable with respect to the main frame.

RELATED REFERENCES

An electric bed generally comprises a frame mounted with a motor and multiple bed planks.

In the prior art, for example, in a frame having a main frame and a secondary frame, the main frame and the secondary frame are made by welding. In general, welding is done in the place of production for accessories. However, if the place of assembly is different from the place of production, the welded frame has to be transported to the place of assembly. Since the welded frame has the disadvantages of occupying large area and difficult to transport, the transport cost is high and the transport effect is low, particularly in large scale transport, not only the transport effect is very low, but also many package materials are wasted.

SUMMARY OF THE INVENTION

An object of the present invention consists in providing an electric bed frame, so as to overcome the abovementioned disadvantages, to greatly increase the transport effect of the electric bed frame, and make it possible to guarantee the strength while decreasing the weight of electric bed frame.

To this end, the present invention provides an electric bed frame comprising longitudinal rail members and transverse rail members, wherein the ends of said longitudinal rail members are connected with the ends of said transverse rail members via riveted parts to form a closed main frame. Then, each member of the electric bed frame can be produced and packaged independently, so that it can be assembled after getting transported to the destination. It is conductive to decrease package volume, to reduce package cost, and to increase effective loading capacity.

Specifically, the electric bed frame further comprises:

a main frame having a pair of longitudinal rail members and a pair of transverse rail members, each longitudinal rail member has a guide slot, a secondary frame having at least four rotatable rollers adapted to be inserted in the guide slots of the main frame and run a movement with respect to the main frame in the guide slots, wherein the longitudinal rail members of said main frame are connected with the adjacent transverse rail members via main frame riveted plates.

With this arrangement, there is no longer need to transport the main frame wholly, but can divide the main frame into several parts and package independently, then the effect of transporting electric bed is greatly improved. In addition, since similar parts can be packaged in group, the waste of package materials is greatly decreased.

In addition, one and/or more of the following arrangements can be applied into the above said electric bed frame:

Furthermore, the longitudinal rail member comprises a lateral surface, and a top surface and a bottom surface extending vertically from two sides of the lateral surface of the longitudinal rail member;

the transverse rail member comprises a lateral surface, and a top surface and a bottom surface extending vertically from two sides of the lateral surface of the transverse rail member;

the main frame riveted plate comprises a first surface adapted to fit the lateral surface of the longitudinal rail member, a second surface adapted to fit the lateral surface of the transverse rail member, a third surface adapted to fit the top surface of the longitudinal rail member and the top surface of the transverse rail member, and a fourth surface adapted to fit the bottom surface of the longitudinal rail member and the bottom surface of the transverse rail member' wherein the third surface and the fourth surface of the main frame riveted plate have riveting holes;

the top surface and the bottom surface of the longitudinal rail member have through-holes corresponding to the riveting holes of the main frame riveted plate;

the top surface and the bottom surface of the transverse rail member have through-holes corresponding to the riveting holes of the main frame riveted plate. With the use of main frame riveted plates, the main frame can be easily assembled by riveting. Then the electric bed frame is more adapted to be packed for transportation, and can be riveted by rivets to use as soon as reaches the destination.

Furthermore, the main frame riveted plate, the longitudinal rail member and the transverse rail member are sheet metal parts. The weight of sheet metal parts are lighter and can save more materials when compared with the rectangular tubes used in the prior bed frame.

Furthermore, the main frame riveted plate, the longitudinal rail member and the transverse rail member are processed with plastic-spray surface treatment before being riveted, so that the metal materials are protected from oxidation and corrosion, and can change the appearance color according to different models.

Furthermore, the secondary frame comprises:

a pair of longitudinal roller plates, each at least provided with two rollers (25), two transverse beams connected with said pair of longitudinal roller plates via secondary frame riveted plates, a motor base arranged between said two transverse beams.

The longitudinal roller plate is provided with rollers so that it can move along the guide slot of the main frame, and the two transverse beams are used to fix the motor base so that the posture of the electric bed can be changed by driving the bed planks with the motor.

Furthermore, the roller plate comprises a lateral surface, and a top surface and a bottom surface extending vertically from the two sides of the lateral surface of the roller plate;

the transverse beam comprises a main surface, and a front surface and a back surface extending vertically from the two sides of the main surface of the transverse beam;

the secondary riveted plate comprises a first surface adapted to fit the lateral surface of the roller plate, a second surface adapted to fit the main surface of the transverse beam, and a pair of rib plates extending from the two sides of the first surface of the secondary frame towards the two sides of its second surface;

wherein the first surface and the second surface of the secondary frame riveted plate have riveting holes;

the lateral surface of the longitudinal roller plate has through-holes corresponding to the riveting holes of the secondary frame riveted plate;

the main surface of the transverse beam has through-holes corresponding to the riveting holes of the secondary frame riveted plate. With the use of this secondary frame riveted plates, the main frame can be easily assembled by riveting. Therefore, the electric bed frame is more adapted to be packed for transportation and can be riveted by rivets to use as soon as reach the destination.

Furthermore, the motor base is provided with upstanding flanges for fixing a motor.

Furthermore, said secondary frame further has a transverse enhancing beam fixed between said pair of longitudinal roller plates via secondary frame riveted plates, so as to enhance the strength of the bed frame.

Furthermore, said secondary frame riveted plate, said transverse beam and said roller plate are sheet metal parts. The weight of sheet metal parts are lighter and can save more materials when compared with the rectangular tubes used in the prior bed frame.

Furthermore, the secondary frame riveted plate, the transverse beam and the roller plate are processed with plastic-spray surface treatment before being riveted, so that the metal materials are protected from oxidation and corrosion, and can change the appearance color according to different models.

Due to abovementioned features, the bed frame of the invention is easy for assembly. Even when the parts plant is far away from the assembly plant, each part of the bed frame can be transported in the form of parts and get assembled after reaches the assembly plant, so as to save transportation cost, meanwhile, the strength of the bed frame assembled in this way is equivalent to that of a welded bed frame.

BRIEF DESCRIPTION OF THE DRAWINGS

It should be understood that all features, alternatives and/or embodiments of the present invention can be associated according to various combinations in so far as they are not incompatible or exclusive with each other.

Further features and advantages of the invention will appear from the following description of embodiments of the invention, given as non-limiting examples, with reference to the accompanying drawings listed hereunder.

DETAILED DESCRIPTION

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

By referring to the embodiments and figures, the present invention is described. In the figures, the same references are used to denote identical or similar items.

Figure 1:
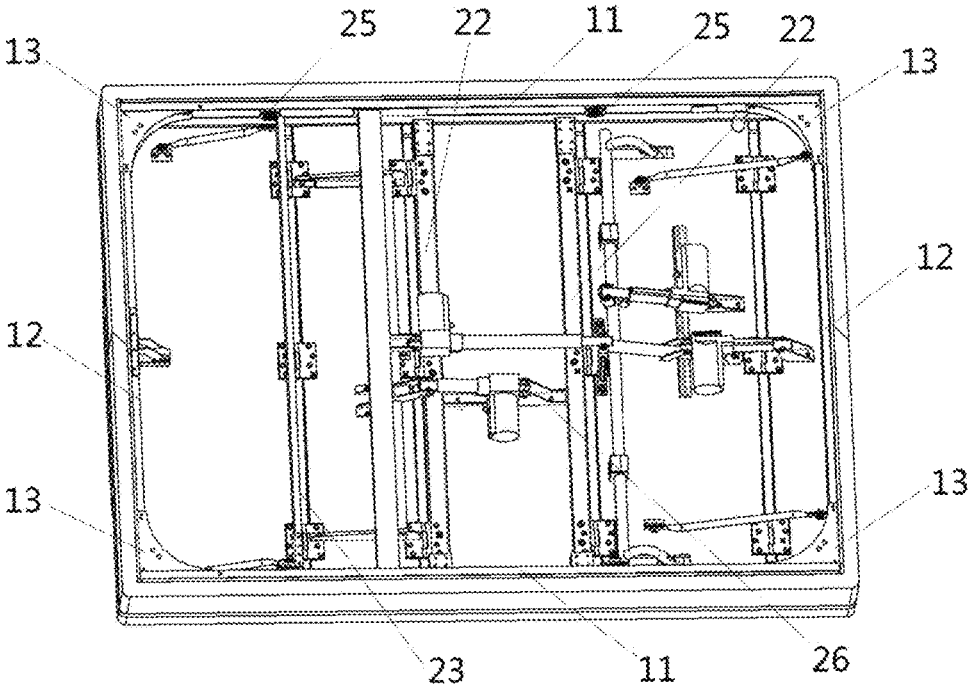
FIG. 1 is a diagrammatic view of an electric bed frame according to an embodiment of the present invention, meanwhile it shows a motor mounted on the bed frame.

Referring to the drawings, FIG. 1, shows an electric bed frame according to an example of the present invention, which comprises a main frame 10 and a secondary frame 20 supporting the use of the main frame, wherein the secondary frame has rollers 25, the main frame has guide slots (not shown) adapted for guiding the movement of the rollers. With this arrangement, the secondary frame 20 can translate with respect to the main frame 10, more details are described as below.

Figure 2:
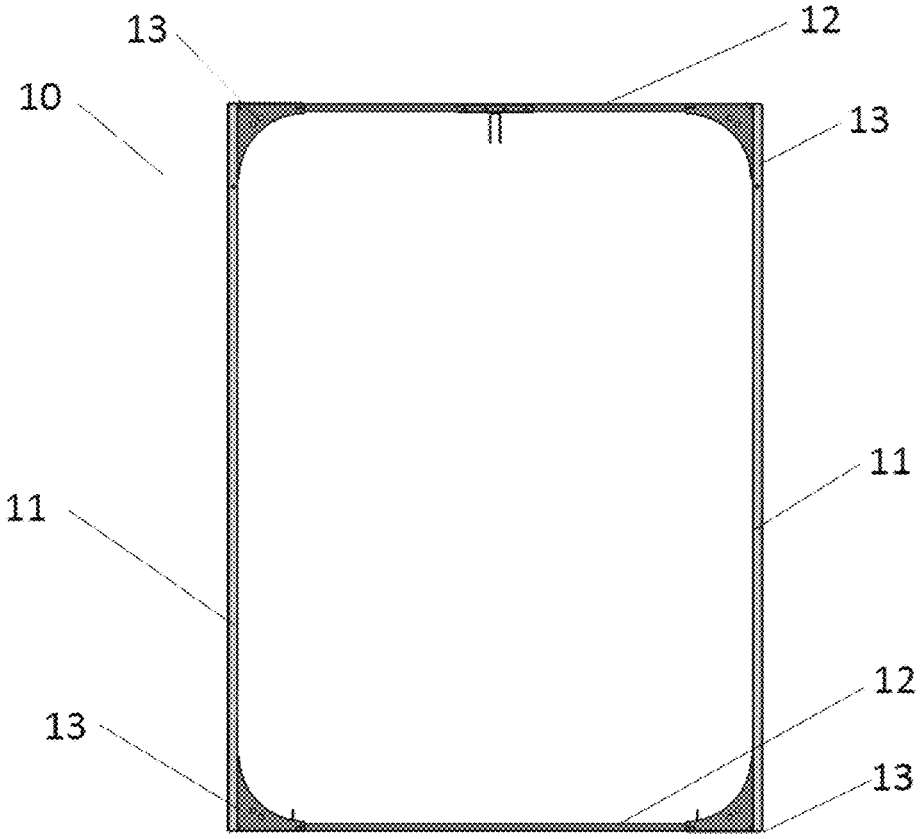
FIG. 2 is a top view of the main frame of the electric bed frame in FIG. 1.

As shown in FIG. 2, the main frame has a pair of longitudinal rail members 11 and a pair of transverse rail members 12, each longitudinal rail member has a guide slot. Wherein, the longitudinal rail members of the main frame are connected with the adjacent transverse rail members via main frame riveted plates 13. In particular, the longitudinal rail members are substantially vertically connected with the adjacent transverse rail members to form a closed rectangular frame, and the longitudinal rail members are slightly longer than the transverse rail members.

Figure 4:
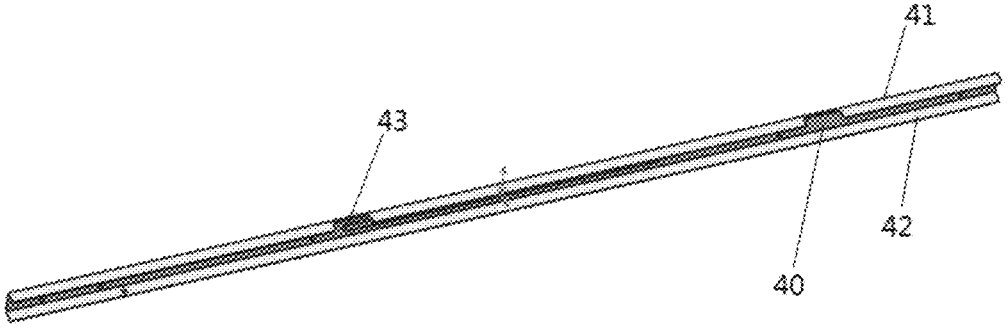
FIG. 4 is a diagrammatic view of the longitudinal rail member of the main frame in FIG. 2.

Referring to FIG. 4, the longitudinal rail member comprises a lateral surface 40, and a top surface 41 and a bottom surface 42 extending vertically from two sides of the lateral surface 40 of the longitudinal rail member, so that a "C" type section is formed. The top surface and the bottom surface of the longitudinal rail member may be formed by bending the two sides of the lateral surface. In particular, the width of the lateral surface of the longitudinal rail member is larger than the width of the top surface and the width of the bottom surface. Alternatively, the longitudinal rail member may only have the top surface or the bottom surface, so that a "L" type section is formed, since the strength of a "L" type section is relatively low, the longitudinal rail member discussed in the example is a "C" type section.

Figure 5:
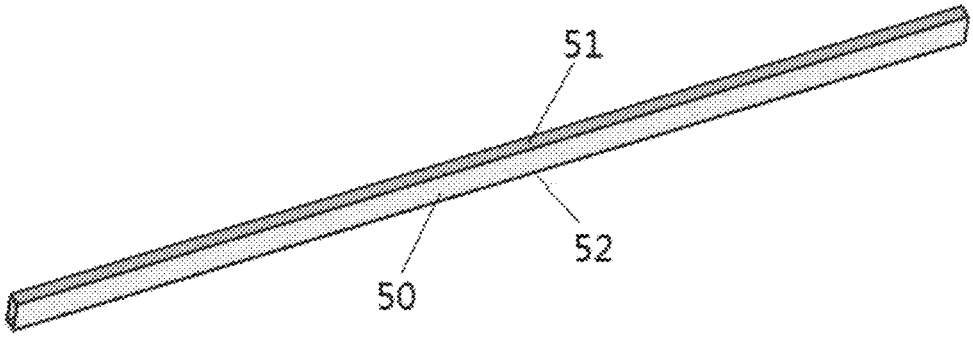
FIG. 5 is a diagrammatic view of the transverse rail member of the main frame in FIG. 2.

Referring to FIG. 5, the transverse rail member comprise a lateral surface 50, and a top surface 51 and a bottom surface 52 extending vertically from two sides of the lateral surface 50 of the transverse rail member. The transverse rail member may be a rectangular tube, or may have a section similar to the "C" type section of the longitudinal rail member. The top surface and the bottom surface of the transverse rail member may be formed by bending the two sides of the lateral surface. In particular, the width of the lateral surface of the transverse rail member is larger than the width of the top surface and the width of the bottom surface. Alternatively, the transverse rail member may only have the top surface or the bottom surface, so that a "L" type section is formed, since the strength of a "L" type section is relatively low, the transverse rail member discussed in the example is a "C" type section.

Figure 6:
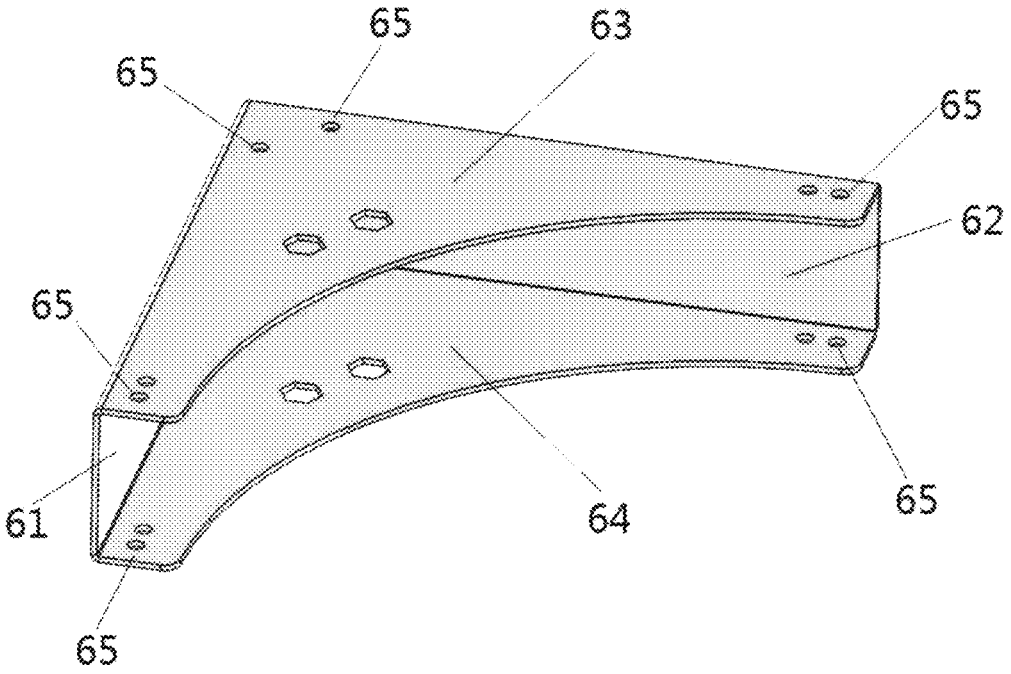
FIG. 6 is a diagrammatic view of the riveted plate of the main frame in FIG. 2.

Referring to FIG. 6, the main frame riveted plate 13 comprises a first surface 61 adapted to fit the lateral surface of the longitudinal rail member, a second surface 62 adapted to fit the lateral surface of the transverse rail member, a third surface 63 adapted to fit the top surface of the longitudinal rail member and the top surface of the transverse rail member, and a fourth surface 64 adapted to fit the bottom surface of the longitudinal rail member and the bottom surface of the transverse rail member, the third and fourth surfaces extending along the two sides of the first and second surfaces.

In particular, due to the longitudinal rail members are substantially vertically connected to the adjacent transverse rail members, the first surfaces of the main frame riveted plates are substantially vertically connected to the second surfaces of the main frame riveted plates, for example formed by bending. Alternatively, the third and fourth surfaces may be rib plates welded on the two sides of the first and second surface.

Furthermore, the third surface and the fourth surface of the main frame riveted plate have riveting holes 65. For matching with the riveting holes, the top surface and the bottom surface of the longitudinal rail member have through-holes corresponding to the riveting holes of the main frame riveted plate, meanwhile the top surface and the bottom surface of the transverse rail member have through-holes corresponding to the riveting holes of the main frame riveted plate.

Preferably, the first surface and the second surface riveted with the main frame have same width, so that the third surface may be parallel to the fourth surface, so that it would be easy to align rivets with the riveting holes of the third and fourth surfaces when assembling. Due to the main frame riveted plate, the main frame may be easily assembled by riveting. Therefore, the electric bed frame is more adapted to be packed for transportation, and can be riveted by rivets to use as soon as reaches the destination.

Preferably, the main frame riveted plate, the longitudinal rail member and the transverse rail member are sheet metal parts. The weight of sheet metal parts are lighter and can save more materials when compared with the rectangular tubes used in the prior bed frame.

Preferably, the main frame riveted plate, the longitudinal rail member and the transverse rail member are processed with plastic-spray surface treatment before being riveted, so that the metal materials are protected from oxidation and corrosion, and can change the appearance color according to different models.

With this arrangement, there is no longer need to transport the main frame in a whole, but can divide the main frame into several parts and package independently, then the effect of transporting electric bed is greatly improved. In addition, since similar parts can be packaged in group, the waste of package materials is greatly decreased.

Figure 3:
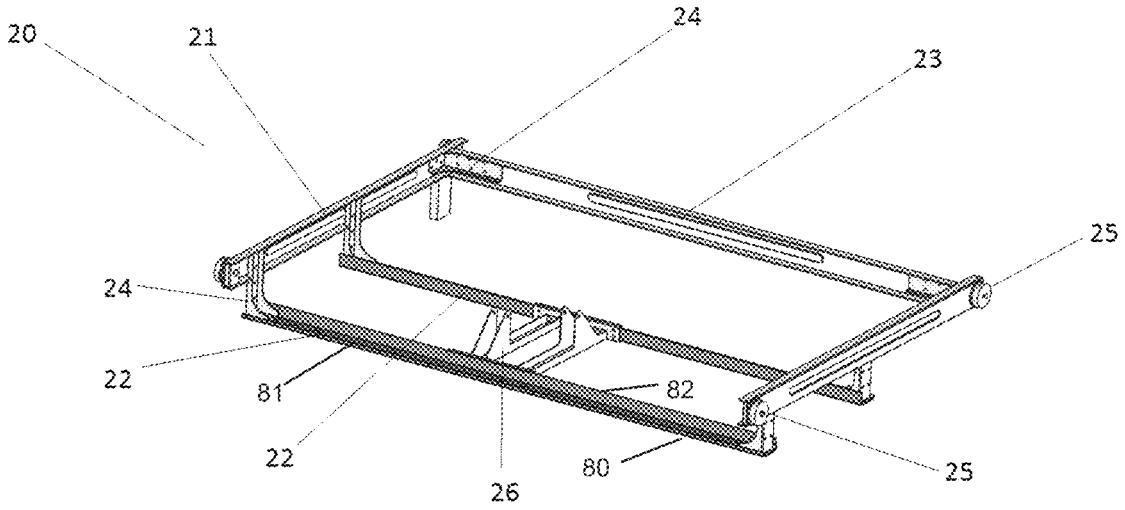
FIG. 3 is a diagrammatic view of the secondary frame of the electric bed frame in FIG. 1.

As shown in FIG. 3, the secondary frame 20 comprises:

a pair of longitudinal roller plates 21, each of them is at least provided with two rollers 25, preferably, both of the two ends of each longitudinal roller plate is mounted with a rotatable roller 25 so as to move in the guide slots of the main frame;

two transverse beams 22 connected with said pair of longitudinal roller plates via secondary frame riveted plates 24, a motor base 26 arranged between said two transverse beams. According to different types of electric bed, it can be arranged with one or more motors;

The two transverse beams 22 are used to fix the motor base so that the posture of the electric bed can be changed by driving the bed planks with the motor. The transverse beam comprises a main surface 80, and a front surface 81 and a back surface 82 extending vertically from the two sides of the main surface of the transverse beam, wherein the width of the main surface is larger than those of the front and back surfaces, wherein the front and back surfaces may be bent from the two sides of the main surfaces.

In particular, the roller plate 21 comprises a lateral surface 70, and a top surface 71 and a bottom surface 72 extending vertically from the two sides of the lateral surface of the roller plate. The rollers are mounted on the side of the lateral surface which is opposite to the extension direction of the front and back surfaces.

Figure 7:
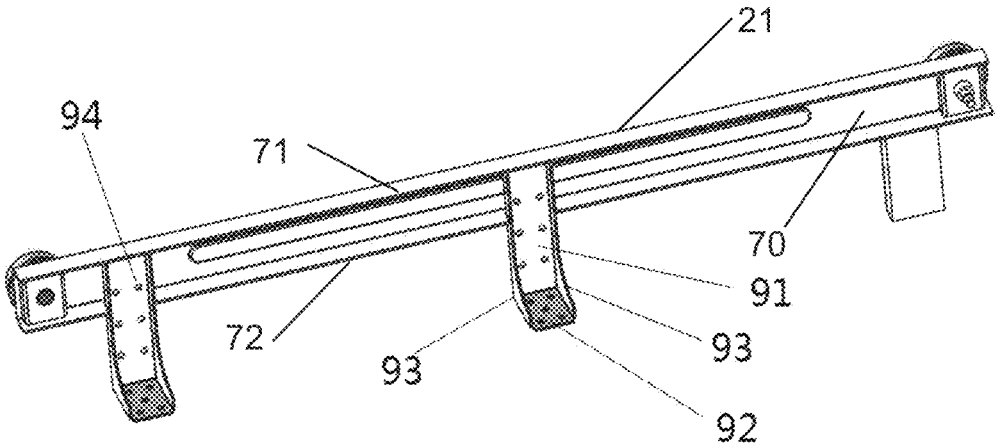
FIG. 7 is a diagrammatic view of the secondary frame riveted plate mounted on the longitudinal roller plate in FIG. 3.

Refer to FIG. 7, the secondary riveted plate 24 comprises a first surface 91 adapted to fit the lateral surface of the roller plate, a second surface 92 adapted to fit the main surface of the transverse beam, and a pair of rib plates 93 extending from the two sides of the first surface of the secondary frame towards the two sides of its second surface. Wherein, the first surface and the second surface 92 of the secondary frame riveted plate has riveting holes 94. To match with the riveting holes, the lateral surface of the longitudinal roller plate has through-holes corresponding to the riveting holes of the secondary frame riveted plate. With the arrangement of the secondary frame riveted plates, the electric bed frame is more adapted to be packed for transportation, and can be riveted by rivets to use.

Preferably, the transverse beams are mounted between the two roller plates and below them by the secondary frame riveted plates, so as to leave space for the motor to be mounted.

Furthermore, the motor base is provided with upstanding flanges. One end of the motor base is mounted on one transverse beam, the other end is mounted on the other transverse beam, the upstanding flanges protruding upwardly between the two ends are used to fix the motor, so that the posture of the electric bed can be changed by driving the bed planks with the motor.

Furthermore, the secondary frame further comprises a transverse enhancing beam fixed between said pair of longitudinal roller plates via secondary frame riveted plates, so as to enhance the strength of the bed frame. In particular, one transverse beam is mounted on one end of the longitudinal roller plate, the other transverse beam is mounted on the middle of the roller plate, and the transverse enhancing beam is mounted on the other end of the longitudinal roller plate.

Preferably, the secondary frame riveted plate, the transverse beam and the roller plate are sheet metal parts. The weight of sheet metal parts are lighter and can save more materials when compared with the rectangular tubes used in the prior bed frame.

Preferably, the secondary frame riveted plate, the transverse beam and the roller plate are processed with plastic-spray surface treatment before being riveted, so that the metal materials are protected from oxidation and corrosion, and can change the appearance color according to different models.

It should be noted that, the embodiments mentioned above are used as examples and cannot be construed as limiting the scope of the invention. On the basis of this, a man skilled in the art could expect other embodiments having the same function within the scope of protection of the application. For example, the present invention also may be used for a bed frame only having a main frame, and other traditional electric bed frames.

Various other embodiments and various changes and modifications to the disclosed embodiment(s) will become apparent to those skilled in the art. Particularly, otherwise explicitly mentioned, all above described features, alternatives and/or embodiments of the present invention can be combined with each other as far as they are not incompatible or mutually exclusive of others. All such other embodiments, changes, and modifications are intended to come within the scope of the appended claims. For example, the transverse enhancing beam can be riveted on the first surface of the secondary frame and be fixed between a pair of longitudinal roller plates by riveting the second surface of the secondary frame on the longitudinal roller plate.

The invention claimed is:

1. An electric bed frame comprising a main frame (10) having a pair of longitudinal rail members (11) and a pair of transverse rail members (12), each longitudinal rail member (11) has a guide slot, a secondary frame (20) comprising a pair of longitudinal roller plates (21), each at least provided with two rollers (25) adapted to be inserted in the guide slots of the main frame (10) and run a movement with respect to the main frame in the guide slots, two transverse beams (22) connected with said pair of longitudinal roller plates via secondary frame riveted plates (24), and wherein the longitudinal rail members (11) of said main frame (10) are connected with the adjacent transverse rail members (12) via main frame riveted plates (13), wherein each said roller plate comprises a lateral surface (70), and a top surface (71) and a bottom surface (72) extending horizontally from the two sides of the lateral surface of the roller plate, each of said two transverse beams comprises a main surface (80), and a front surface (81) and a back surface (82) extending vertically from the two sides of the main surface of the transverse beam, each said secondary frame riveted plate comprises a first surface (91) adapted to fit the lateral surface of the roller plate, a second surface (92) adapted to fit the main surface of the transverse beam, and a pair of rib plates (93) extending from the two sides of the first surface of the secondary frame riveted plate towards the two sides of its second surface, wherein the first surface (91) and the second surface (92) of the secondary frame riveted plate has riveting holes (94), the lateral surface of each longitudinal roller plate has through-holes corresponding to the riveting holes of the secondary frame riveted plate, and, the main surface of each transverse beam has through-holes corresponding to the riveting holes of the secondary frame riveted plate.

2. The electric bed frame according to claim 1, wherein each longitudinal rail member comprises a lateral surface (40), and a top surface (41) and a bottom surface (42) extending horizontally from two sides of the lateral surface (40) of each longitudinal rail member, each transverse rail member comprises a lateral surface (50), and a top surface (51) and a bottom surface (52) extending horizontally from two sides of the lateral surface (50) of the transverse rail member, and each main frame riveted plate (13) comprises a first surface (61) adapted to fit the lateral surface of each longitudinal rail member, a second surface (62) adapted to fit the lateral surface of each transverse rail member, a third surface (63) adapted to fit the top surface of each longitudinal rail member and the top surface of each transverse rail member, and a fourth surface (64) adapted to fit the bottom surface of each longitudinal rail member and the bottom surface of each transverse rail member, wherein the third surface and the fourth surface of each main frame riveted plate have riveting holes (65), the top surface and the bottom surface of each longitudinal rail member have through-holes corresponding to the riveting holes of each main frame riveted plate, the top surface and the bottom surface of each transverse rail member have through-holes corresponding to the riveting holes of each main frame riveted plate.

3. The electric bed frame according to claim 2, wherein said main frame riveted plates, said longitudinal rail members and said transverse rail members are sheet metal parts.

4. The electric bed frame according to claim 1, further comprising a motor base (26) arranged between said two transverse beams, wherein said motor base is provided with upstanding flanges.

5. The electric bed frame according to claim 1, wherein said secondary frame further has a transverse enhancing beam (23) fixed between said pair of longitudinal roller plates via secondary frame riveted plates.

6. The electric bed frame according to claim 1, wherein each secondary frame riveted plate, each transverse beam and each roller plate are sheet metal parts.

7. The electric bed frame according to claim 6, wherein each secondary frame riveted plate, each transverse beam and each roller plate are processed with plastic-spray surface treatment before being riveted.

* * * * *